US006728977B1

(12) United States Patent
Knight

(10) Patent No.: US 6,728,977 B1
(45) Date of Patent: May 4, 2004

(54) IN-BED SHAMPOO SYSTEM

(76) Inventor: Ronit Knight, 4642 Sparrows Nest, San Antonio, TX (US) 78250

( * ) Notice: Subject to any disclaimer, the term of this patent is extended or adjusted under 35 U.S.C. 154(b) by 0 days.

(21) Appl. No.: 10/267,297

(22) Filed: Oct. 9, 2002

(51) Int. Cl.[7] ..... A45D 19/00

(52) U.S. Cl. ..... 4/515; 4/516; 4/518; 4/519; 4/520; 4/521

(58) Field of Search ..... 4/515–523, 625, 4/626; 132/212; 2/174

(56) References Cited

U.S. PATENT DOCUMENTS

| | | | | | |
|---|---|---|---|---|---|
| 2,850,742 | A | | 9/1958 | Glintz | |
| D195,396 | S | | 6/1963 | Barkus | |
| 3,456,655 | A | * | 7/1969 | Hale | 132/212 |
| 3,694,826 | A | | 10/1972 | Pugh | |
| 3,731,325 | A | | 5/1973 | Guarrasi | |
| 3,996,946 | A | * | 12/1976 | Craig | 132/212 |
| 4,361,158 | A | * | 11/1982 | Baker | 132/212 |
| 5,099,865 | A | * | 3/1992 | Flannery et al. | 4/516 |
| 5,146,629 | A | * | 9/1992 | Barnes | 4/521 |
| 5,245,713 | A | | 9/1993 | Tickle | |
| 5,335,384 | A | | 8/1994 | Foster et al. | |
| 5,381,562 | A | | 1/1995 | Holloway et al. | |
| 5,528,776 | A | | 6/1996 | Carmichael | |
| 5,551,088 | A | * | 9/1996 | Stepp | 4/521 |
| 5,842,238 | A | | 12/1998 | Herrick et al. | |
| 6,519,777 | B1 | * | 2/2003 | Speelman | 4/521 |

OTHER PUBLICATIONS

Harriet Carter®, Harrier Carter Catalog, p. 99, North Wales, Pennsylvania, USA (Date Unknown).

* cited by examiner

*Primary Examiner*—Tuan N. Nguyen
(74) *Attorney, Agent, or Firm*—Kammer Browning PLLC

(57) ABSTRACT

A portable pump-operated shampoo unit which includes a waterproof inclined body ramp for positioning a person's upper torso and head, a removable reservoir for water storage, a pumping means for pumping water from the reservoir through a spraying means to the person's head. The system also includes a waterproof cape having concave inserts to promote drainage of the water and attachment means to hold the cape in position for drainage. The system also includes a receptacle for collecting the water via a funnel which connects the cape to a drainage receptacle.

11 Claims, 2 Drawing Sheets

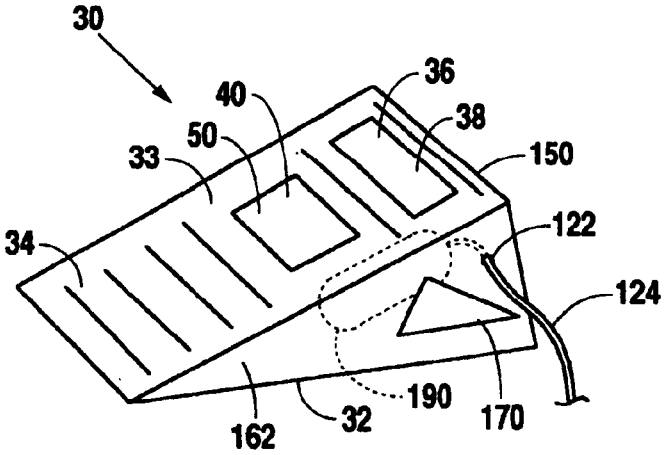
Fig. 3
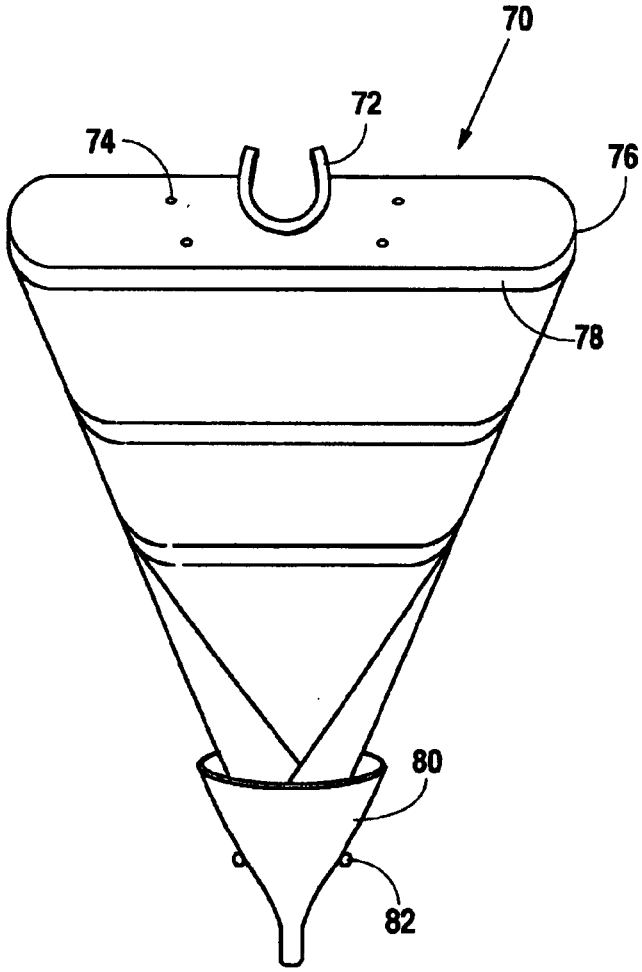
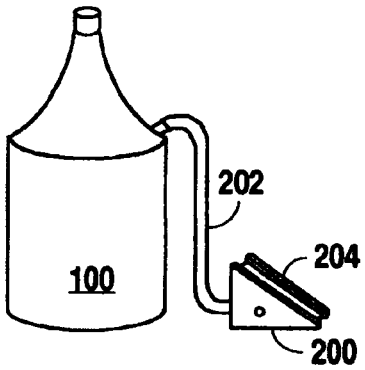
Fig. 5
Fig. 4

IN-BED SHAMPOO SYSTEM

BACKGROUND OF THE INVENTION

1. Field of the Invention

The present invention relates generally to washing devices for washing a person's hair. The present invention relates more specifically to a portable system for shampooing the hair of a bedridden person.

2. Description of the Related Art

It is very difficult to wash the hair of a bedridden patient, particularly one who is immobile or who must not get certain body parts wet. The in-bed shampoo process is very uncomfortable for the person whose hair is being washed and the shampoo results are often unsatisfactory, leaving the hair inadequately cleaned and rinsed. Moreover, the person washing the hair has an awkward task, often unable to keep the patient dry and immobile.

The shampoo basins typically used in hospitals and nursing homes are rigid, uncomfortable reservoir devices which do not support the neck, spine, or shoulders of the patient. The patient's head is usually tipped back at an uncomfortable and unnatural angle against the basin wall in order to capture the wash water in the basin. Water can flow down the neck and back from the patient's scalp, wetting the bed linens in the process. Efforts to develop devices and methods for shampooing the hair of bedridden persons have led to various designs for shampoo units as exemplified in the following patent disclosures.

U.S. Pat. No. 2,850,742 issued to Glintz on Sep. 9, 1958 entitled PORTABLE SHAMPOO CABINET describes a shampoo cabinet which carries water tanks for fresh and used water which can be wheeled to the patient's bedside. The device also has a drain tank and a pump for dispensing fresh water. A shampoo basin and spray nozzle are stored on the unit.

U.S. Pat. No. 3,694,826 issued to Pugh on Oct. 3, 1972 entitled PORTABLE SHAMPOOING UNIT discloses a portable shampooing unit for bedridden patients which includes a portable cart with shampoo bowl, water source, waste water container, and water heating unit. The unit rolls and requires an electric power source.

U.S. Pat. No. 3,731,325 issued to Guarrasi on May 8, 1973 entitled PORTABLE HAIR WASH SINK ATTACHMENT describes a portable unit with a board section and a neck yoke section. The yoke slides along the board and fits around the neck of the person whose hair is being washed. The front of the yoke has a dish which is placed under the user's chin for excess drainage. Water flows from the dish, down the board and into the sink.

U.S. Pat. No. 5,245,713 issued to Tickle on Sep. 21, 1993 entitled HAIR WASHING UNIT discloses a unitary, hollow, molded shell. The shell has a peripheral wall and a central recessed well. There are two drains, one for storage of waste water in the shell, and one for waste water disposal.

U.S. Pat. No. 5,335,384 issued to Foster et al. on Aug. 9, 1994 entitled HOSPITAL BED HEAD EXTENDER AND ACCESSORY THEREFOR describes an extender device for positioning at the head of a hospital bed. A basin is used in conjunction with the extender for shampooing a patient's head.

U.S. Pat. No. 5,381,562 issued to Holloway et al. on Jan. 17, 1995 entitled CONTOURED BASIN discloses a portable basin with body supporting contour and self-stabilizing features. The basin provides an integral elevated platform in its bottom for supporting a body part, such as the head of a person.

U.S. Pat. No. 5,528,776 issued to Carmichael on Jun. 25, 1996 entitled PORTABLE PUMP OPERATED WASHING BASIN describes a portable washing device which includes a slanted inner liner for water drainage and an upper portion with a curved, cushioned edge. The water flows out of a mesh screen between the upper and lower portions of the basin. The basin has a removable, refillable water tank which is connected to a sprayer with nozzle.

U.S. Pat. No. 5,842,238 issued to Herrick et al. on Dec. 1, 1998 entitled MOVABLE WASHSTAND AND ASSOCIATED FOLDING CART discloses a device for supplying water having a spray nozzle, a head rest, a catch basin, drain and bladder for temporarily holding discharge water, and an electrical outlet which are all mounted on a wheeled frame. The device can be connected to a remote sink and electrical supply. A self-supporting movable wash pan is also disclosed.

Each of the above efforts to provide an easy to use and comfortable shampoo device fail in certain respects. Most of these basins present rigid neck supporting surfaces which are very uncomfortable and ill-fitted to the patient. Some of these units are also quite complex and unwieldy to maneuver, especially in the congested area around the typical hospital bed. Furthermore, it is often important that a patient maintain dry areas on their body and the caregiver must shampoo the hair without wetting these areas. For example, the patient's spine must stay dry when an indwelling epidural anesthesia catheter is in place. Therefore, the primary object of the present invention, is an apparatus which allows the caregiver to provide a comfortable, thorough shampoo without compromising the patient's condition due to hyperextension of the neck or unwanted moisture on skin surfaces or external devices.

SUMMARY OF THE INVENTION

The new shampoo system of the present invention has, as its goal, the delivery of a comfortable and effective shampoo for a bedridden individual. The apparatus provides a water source and drainage mechanism as indicated and described in some of the devices in the prior art above, but with the advantages of maintaining dryness for the patient and minimal manipulation of the patient. Unlike many of the prior art systems, the present invention can be implemented in a very confined area without unwieldy tables, stands, and carts.

The system of the present invention includes a drainage cape with fastenable collar and means for attachment to supports which hold the cape at an angle which prevents water from flowing onto the patient. The waterproof cape has concave inserts that mold the cape into a funnel shape to direct the water into a drainage receptacle. Another reservoir holds clean water for shampooing which is pumped through tubing to the patient.

Additionally, the present invention utilizes a cushioned waterproof wedge-shaped body ramp which is used for positioning the patient for the shampoo in bed. The ramp is hollow and stores the pump device, hoses, and shower head. The body ramp has a gradually curved indentation at the raised end of the upwardly slanting top surface to position the patient's head and neck comfortably and to ensure water drainage.

Thus, using the shampoo unit of the present invention, the patient is first positioned in the desired location on the body ramp. Once positioned, the operator of the shampoo unit attaches the fastenable collar of the drainage cape around the patient's neck such that the distal portions of the cape extend over the suspension means of the body ramp and down the drainage cape into the drainage funnel. As the operator activates the pump, the water is directed from the clean water reservoir through the tubing and nozzle and onto the patient's head as the shampoo is given. The drainage water is allowed to run down the drainage cape, through the funnel and into the drainage receptacle. The patient receives a thorough shampoo, but remains dry and comfortable throughout the procedure. In summary, the present invention utilizes simple, inexpensive equipment, namely, a body ramp with pumping means, a reservoir, a receptacle, and a flexible drainage cape, to provide an effective, simple-to-administer in-bed shampoo which maintains patient dryness and comfort.

BRIEF DESCRIPTION OF THE DRAWINGS

FIG. 3 is a detailed schematic diagram showing the various components of the underside of the body ramp.

FIG. 4 is a schematic diagram showing the various elements of the flexible drainage cape of the present invention.

FIG. 5 is a schematic diagram showing the foot pump of the present invention.

DESCRIPTION OF THE PREFERRED EMBODIMENTS

Figure 1:
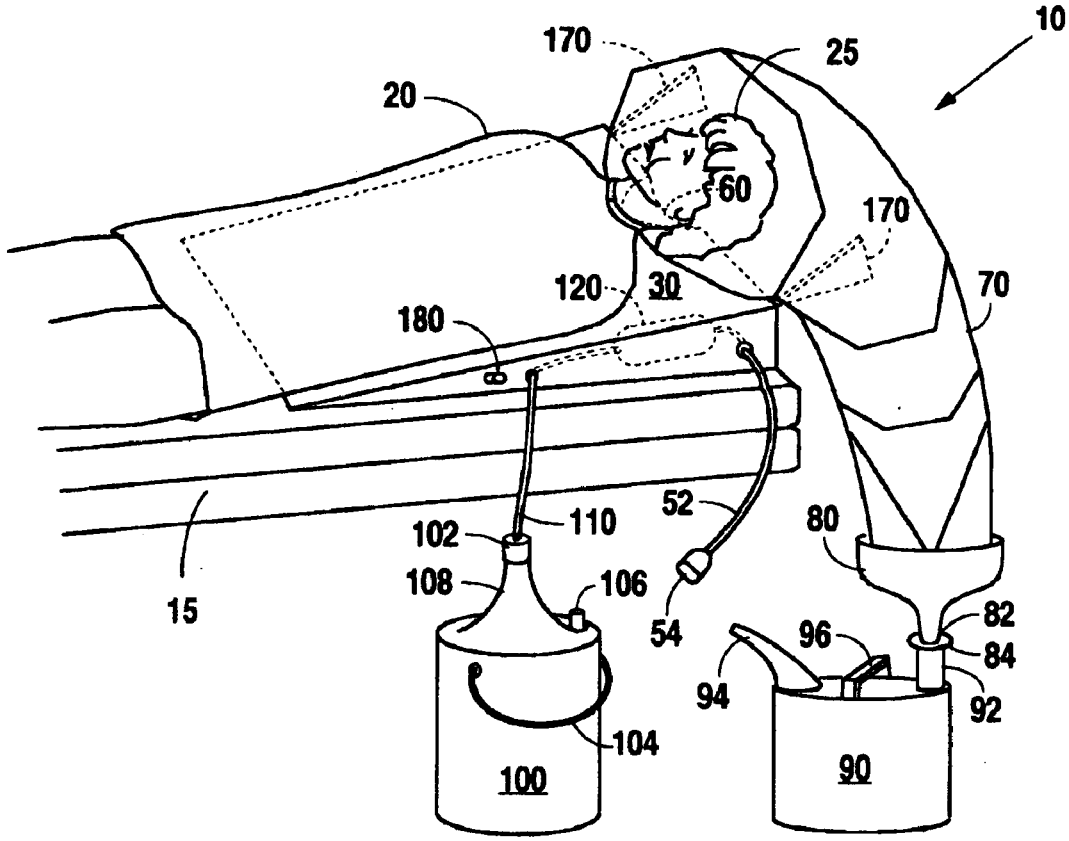
FIG. 1 is a schematic diagram illustrating the shampoo unit of the present invention.

Reference is made first to FIG. 1 for an overview of the shampoo unit 10 of the present invention. The patient 20 is positioned on the body ramp 30 while recumbent on the bed 15. The patient's head 25 is positioned on the body ramp 30, such that the head 25 fits on a curved indentation 60 on the body ramp 30 to allow water to drain from the patient's head 25 onto a waterproof cape 70 and into a drainage funnel 80 and drainage receptacle 90. The drainage funnel 80 has locking means 82 located on either side of the funnel 80 which attach to locking fasteners 84 on either side of the inlet 92 on the drainage receptacle 90. The drainage receptacle 90 also has a spout 94 and handle 96 for ease of use. Water flows from a clean water reservoir 100 via an outlet 102 through intake hose 110 via a pump 120 positioned within the body ramp 30, through output tubing 52 and spray nozzle 54. The water is directed onto the patient's head 25 from the spray nozzle 54. The clean water reservoir 100 has a handle 104 and an air vent 106 located on the upper surface 108 of the reservoir 100.

Figure 2:
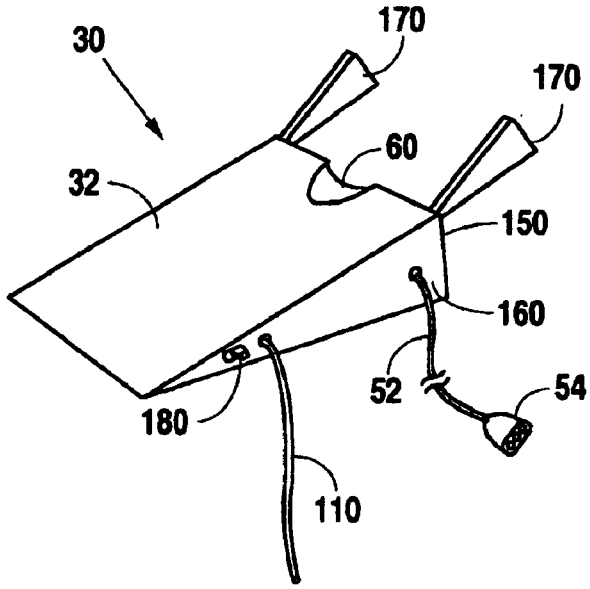
FIG. 2 is a detailed schematic diagram showing the body ramp and attachments of the present invention.

Continuing, FIG. 2 is a detailed schematic diagram showing the body ramp 30 and associated attachments of the present invention. The body ramp 30 has a hollow soft, waterproof outer shell 150 which has an upwardly slanting surface 32 on which to position a patient (not shown) for the shampoo. As noted previously, the curved indentation 60 in the body ramp 30 on the upwardly slanting surface 32 is designed to allow water to flow away from the patient's head (not shown). The body ramp 30 has two support means 170 positioned on either side of the body ramp 30, which are designed to hold the drainage cape (not shown but described with FIG. 4 below) and prevent water from flowing over the sides of the drainage cape and onto the patient or bed. The support means 170 each rotate 180° to rest against the side of the body ramp 30 for ease of storage. An on/off switch 180 is positioned on the side of the body ramp 30 for activating the pump which is used to create water flow. An input tubing 110, which unscrews and is removable for storage, is located on the side of the body ramp 30, extending from a reservoir for fresh water through the side wall 160 of the body ramp shell 150 to the pump inside the shell 150. An output hose 52 which unscrews and is removable for storage, extends from the pump through the side wall 160 of the body ramp shell 150, and is attached to a spray nozzle 54.

Reference is now made to FIG. 3 for a detailed description of the underside 33 of the body ramp 30. A plurality of raised ribbed strips 34, designed to prevent slippage of the shampoo unit 10, are arranged across the underside 33 of the body ramp 30. There is also a door 36 to a pump storage area 38 contained in the hollow shell 150 of the body ramp 30. Additionally, there is a door 40 to a storage area 50 for the output tubing 52 and spray nozzle 54. On the side wall 162 of the body ramp shell 150 is an opening 122 for the pump electrical cord 124.

Reference is now made to FIG. 4 for a description of the various elements of the flexible drainage cape 70 of the present invention. The waterproof drainage cape 70 is designed with a fastenable collar 72 and attachment means 74 at the shoulders in order to be securely positioned over the suspension means 170 shown in FIGS. 1–3. The attachment means 74 are designed to secure and position the body of the cape 70 to the support means 170 such that the water flows into the center of the cape 70 and away from the patient's head and shoulders. The cape 70 contains a plurality of sewn tubular sleeves 76 through which concave inserts 78 with locking hinges are threaded to position the drainage cape 70 so as to direct the flow of water away from the patient 20 and along the valley created by the concave inserts 78. The distal portion of the drainage cape 70 is placed into the drainage funnel 80 to allow the water to drain into the drainage receptacle 90.

The shampoo unit 10 of the present invention may be powered by a small electric pump 190 as shown in FIG. 3 or by a foot pump 200 as shown in FIG. 5. Either of these devices may be stored within the body ramp shell 150 pump storage compartment 38. If an electric pump 190 is utilized, the power cord 192 from the pump 190 extends through the side wall 160 of the body ramp shell 150 to a power source. The on/off switch 180 is located on the side wall 160 of the body ramp shell 150 as described above. Alternatively, if a foot pump 200 is used, tubing 202 connects the foot pump 200 to the reservoir 100. The foot pump 200 is operated by pressure on the foot pedal 204 which is positioned on the floor by the side of the patient's bed (not shown).

Although the present invention has been described in conjunction with certain preferred embodiments and certain specific applications, it is anticipated that those skilled in the art will discern further embodiments and applications that fall within the scope of the invention and the following appended claims.

I claim:

1. A portable shampoo system, said system comprising:

a body ramp for positioning a person's upper torso and head;

a removable reservoir for water;

a spraying means connected to said reservoir for spraying the water;

a pumping means for pumping the water from said reservoir to said spraying means;

a drainage cape positioned to promote drainage of the water;

a receptacle for collecting the drained water; and a funnel connecting said cape with said receptacle.

2. The portable shampoo system of claim 1 wherein said body ramp further comprises:

a hollow waterproof wedge-shaped shell with an inclined top surface, a bottom surface containing raised non-skid means, and supporting side walls;

a storage area for said pumping means contained within said hollow shell; and a storage area for said spraying means contained within said hollow shell.

3. The portable shampoo system of claim 1, further comprising:

means for suspending said drainage cape from said side walls of said body ramp such that the water flow is directed away from said person's upper torso and head.

4. The portable shampoo system of claim 3, wherein said drainage cape further comprises:

a fastenable collar for attachment to said person;

attachment means for connection to said means for suspending from the body ramp;

a plurality of sleeves on said drainage cape; and a plurality of concave inserts wherein the concave inserts are threaded through said sleeves on said drainage cape to promote drainage into said funnel.

5. The portable shampoo system of claim 1, further comprising:

a curved indentation in said inclined top surface of said body ramp, such that the head of said person is supported at a comfortable angle for drainage of the water.

6. The portable shampoo system of claim 1, wherein said spraying means further comprises:

input tubing wherein one end of said tubing is attached to the reservoir of water and the other end of said tubing is attached to said pumping means; and output tubing wherein one end of said tubing is attached to said pumping means and the other end of said tubing is attached to a nozzle for spraying.

7. The portable shampoo system of claim 6, wherein said removable reservoir for water further comprises:

an outlet for said input tubing;

a handle; and an air vent.

8. The portable shampoo system of claim 6, wherein said pumping means is electrical.

9. The portable shampoo system of claim 6, wherein said pumping means is foot operated.

10. The portable shampoo system of claim 1, wherein said receptacle for collecting water further comprises:

an inlet for insertion of said funnel;

attachment means for connection to said funnel;

a spout for drainage; and a handle.

11. The portable shampoo system of claim 1, wherein said funnel further comprises:

an inlet for accepting said cape;

an outlet for drainage into the receptacle; and attachment means for connection to the receptacle.

* * * * *